US009389583B2

(12) United States Patent
Maeda et al.

(10) Patent No.: US 9,389,583 B2
(45) Date of Patent: Jul. 12, 2016

(54) IMAGE FORMING APPARATUS AND PROCESS CARTRIDGE

(71) Applicant: CANON KABUSHIKI KAISHA, Tokyo (JP)

(72) Inventors: Naoki Maeda, Suntou-gun (JP); Atsushi Takasaka, Mishima (JP); Ryuta Murakami, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/602,169

(22) Filed: Jan. 21, 2015

(65) Prior Publication Data

US 2015/0212480 A1 Jul. 30, 2015

(30) Foreign Application Priority Data

Jan. 27, 2014 (JP) ..... 2014-012729

(51) Int. Cl.
*G03G 15/00* (2006.01)
*G03G 21/18* (2006.01)
*G03G 15/02* (2006.01)

(52) U.S. Cl.
CPC ..... *G03G 21/1814* (2013.01); *G03G 15/0225* (2013.01); *G03G 21/1842* (2013.01)

(58) Field of Classification Search
CPC ..... G03G 21/1647; G03G 21/1814; G03G 21/1619; G03G 21/18; G03G 21/1821; G03G 21/1842
USPC ..... 399/110, 100
See application file for complete search history.

(56) References Cited

U.S. PATENT DOCUMENTS

2004/0062565 A1* 4/2004 Itabashi ..... G03G 15/0258 399/100
2006/0140664 A1* 6/2006 Takami ..... G03G 15/0258 399/100
2006/0245787 A1* 11/2006 Ito ..... G03G 21/0035 399/111
2012/0002999 A1* 1/2012 Itabashi ..... G03G 15/0258 399/100
2012/0207514 A1* 8/2012 Tanaka ..... G03G 15/0291 399/115

FOREIGN PATENT DOCUMENTS

JP 2002-304046 A 10/2002

* cited by examiner

*Primary Examiner* — Walter L Lindsay, Jr.
*Assistant Examiner* — Jessica L Eley
(74) *Attorney, Agent, or Firm* — Canon USA, Inc., IP Division

(57) ABSTRACT

An image forming apparatus includes an apparatus main-body to and from which a process cartridge can be attached and detached. The process cartridge includes an image carrying member to carry an image, a charging member to charge the image carrying member, a cleaning member to clean the charging member by contacting it, and a force receiving unit to receive a force for moving the cleaning member in a longitudinal direction of the image carrying member. The apparatus main-body includes a slope portion which slopes in a direction in which the process cartridge is attached and contacts the force receiving unit to apply the force in a process where the process cartridge is attached to the apparatus main-body, and the slope portion applies the force to the force receiving unit to move the cleaning member from an inside to an outside of a region where an image can be formed.

15 Claims, 7 Drawing Sheets

IMAGE FORMING APPARATUS AND PROCESS CARTRIDGE

BACKGROUND OF THE INVENTION

1. Field of the Invention

The present invention relates to an image forming apparatus and a process cartridge.

The image forming apparatus is defined here as the one that forms an image on a recording medium. For example, the image forming apparatus includes an electrophotographic copying machine, an electrophotographic printer (a light emitting diode (LED) printer and a laser beam printer), an electrophotographic facsimile machine, and an electrophotographic word processor using an electrophotographic image forming process.

The recording medium is the one on which the image is formed, and refers to a recording sheet and an over head projector (OHP) sheet, for example.

The process cartridge refers to the one that can be attached to and detached from a main body of the image forming apparatus.

2. Description of the Related Art

Heretofore, the image forming apparatus has adopted a process cartridge system which integrates an electrophotographic photosensitive member (hereinafter referred to as photosensitive drum) as an image carrying member with a process unit acting thereon, and which can be attached to and detached from the main body of the image forming apparatus (hereinafter referred to as apparatus main-body). The process cartridge system can improve operability because the maintenance of the apparatus can be performed by a user itself.

The process cartridge adopts a corona discharge system or a roller charging system as an example of a charging unit (a charging member or a charging device) for charging the photosensitive drum. The corona discharge system uses a charging wire to generate corona discharge for uniformly discharging a surface of the photosensitive drum. A large number of configurations have been proposed in which a cleaning member is provided as a means of periodically cleaning dirt attached on the charging wire and is moved in a longitudinal direction along the charging wire.

However, if the cleaning member is left in an image forming area in the longitudinal direction at the time of forming an image, the cleaning member covers the wire. In other words, the cleaning member inhibits the wire from charging the photosensitive drum to cause an image defective due to a charging defective. Japanese Patent Application Laid-Open No. 2002-304046, for example, discusses a configuration, as a means of solving the above problem, in which leaving the cleaning member in the image forming area prevents the process cartridge from being attached to the apparatus main-body.

SUMMARY OF THE INVENTION

The present invention develops the above conventional example.

According to an aspect of the present invention, an image forming apparatus configured to form an image on a recording medium in which an apparatus main-body to and from which a process cartridge can be attached and detached is provided. The process cartridge includes an image carrying member configured to carry an image, a charging member configured to charge the image carrying member, a cleaning member configured to clean the charging member by contacting the charging member, and a force receiving unit configured to receive a force for moving the cleaning member in a longitudinal direction of the image carrying member. The apparatus main-body includes a slope portion which slopes in a direction in which the process cartridge is attached and contacts the force receiving unit to apply the force in the process where the process cartridge is attached to the apparatus main-body, and, in a case where a region where an image can be formed on the image carrying member is taken as an image forming region, the slope portion applies the force to the force receiving unit to move the cleaning member from the inside to the outside of the image forming region.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 1:
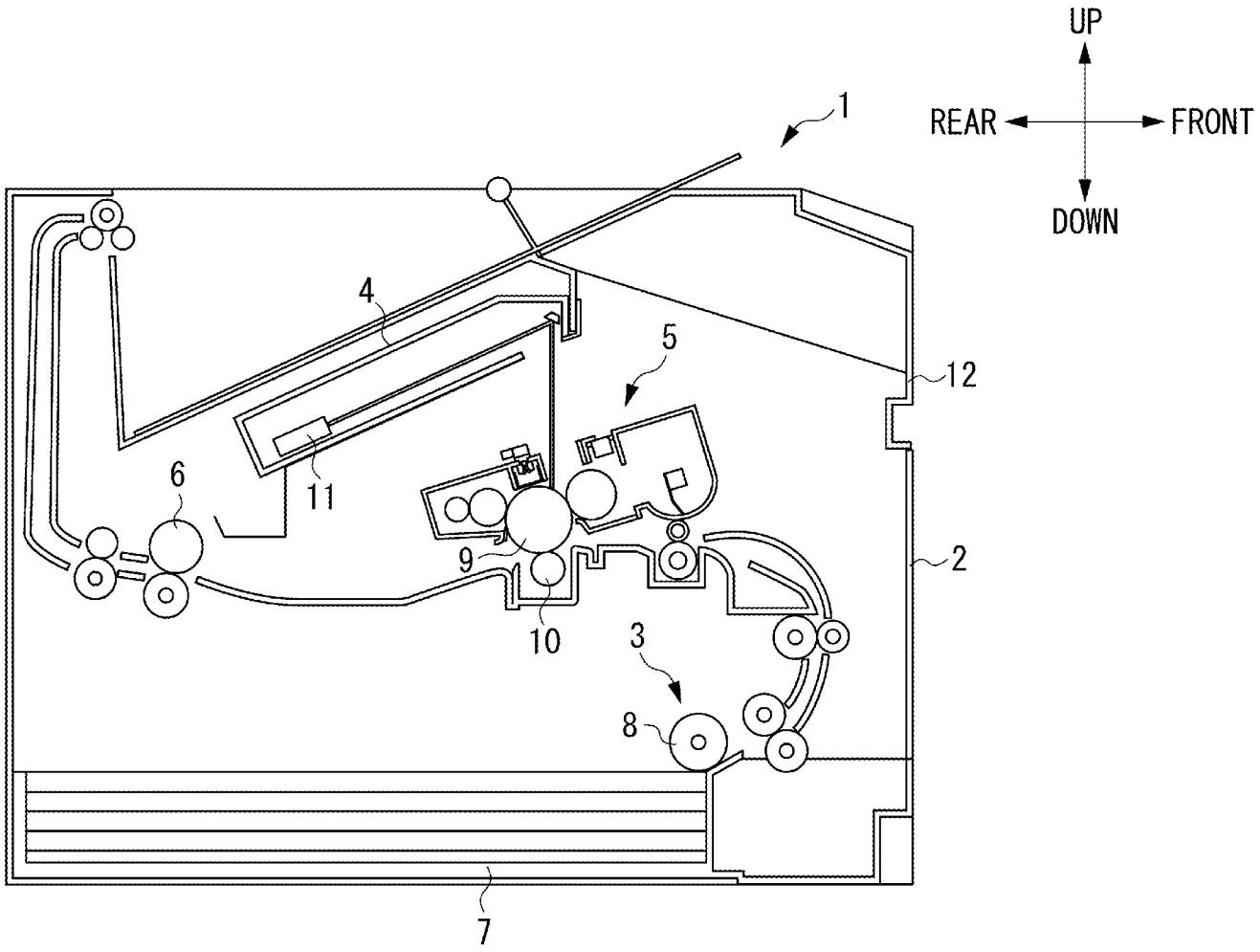
FIG. 1 is a sectional schematic diagram illustrating an outline of an image forming apparatus.

A configuration of an image forming apparatus is described below with reference to FIG. 1. FIG. 1 is a sectional schematic diagram illustrating an outline of the image forming apparatus.

The following description is made in a direction in which a user using the image forming apparatus views. In FIG. 1, the right-hand side is referred to as "front," the left-hand side is referred to as "rear," the near side is referred to as "left," the far side is referred to as "right," and up and down directions are referred to as "up" and "down."

The image forming apparatus includes an apparatus main-body 2 and a process cartridge 5 that is attachable to and detachable from the apparatus main-body 2. As illustrated in FIG. 1, the apparatus main-body 2 includes a paper feeding unit 3 for supplying paper as a recording medium, an exposure device 4, and a fixing device 6 for thermally fixing a developed image transferred to the paper.

The paper feeding unit 3 is provided in the lower portion of the apparatus main-body 2 and includes a paper feed tray 7 and a paper feeding roller 8. Each sheet of papers stored in the paper feed tray 7 is fed by the paper feeding roller 8 into the process cartridge 5 (between a photosensitive drum 9 and a transfer roller 10).

The exposure device 4 is provided in the upper portion of the apparatus main-body 2. In the exposure device 4, laser beams based on image data and emitted from a laser emitting unit 11 are scanned at a high speed on a surface of the photosensitive drum 9 being an image carrying member to expose the surface of the photosensitive drum 9.

Figure 2A:
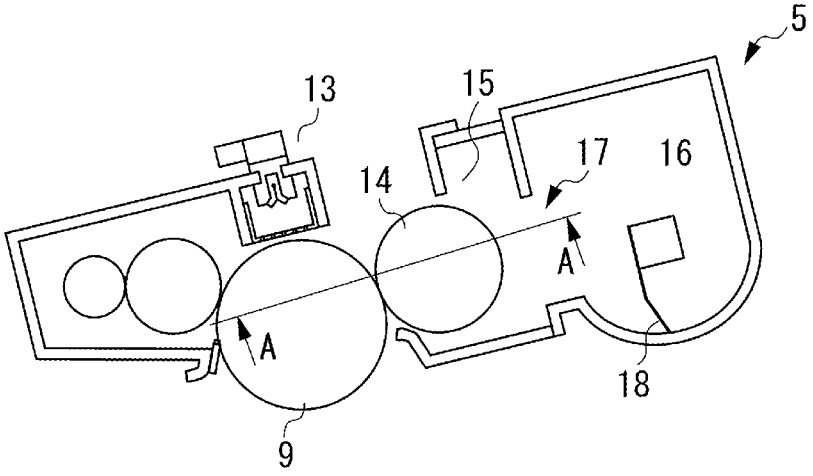
FIGS. 2A and 2B are cross sections of a process cartridge.

The configuration of the process cartridge which is a characterizing portion of the present invention is described below with reference to FIGS. 2A and 2B. FIG. 2A is a cross section of the process cartridge 5.

As illustrated in FIG. 2A, the process cartridge 5 is provided under the exposure device 4 (illustrated in FIG. 1) and detachably attached to the apparatus main-body 2 through an opening formed when a front cover 12 (illustrated in FIG. 1) provided on the apparatus main-body 2 is opened.

The process cartridge 5 includes the photosensitive drum 9, a charging device 13, a developing roller 14 being a developer carrying member, a layer thickness regulating member 15, a developer storage unit 16 for storing a developer, a developer opening portion 17, and a conveyance member 18 for stirring and conveying the developer.

In the thus configured process cartridge 5, the surface of the photosensitive drum 9 is uniformly charged by the charging device 13 and then exposed by laser beams scanned at a high speed from the exposure device 4 (illustrated in FIG. 1). This forms an electrostatic latent image based on the image data on the photosensitive drum 9. The developer in the developer storage unit 16 is supplied to the developing roller 14 through the developer opening portion 17 by being stirred. Accompanied by the rotation of the developing roller 14, the developer enters between the developing roller 14 and the layer thickness regulating member 15, and is triboelectrically charged. Then, a thin layer with a certain thickness is carried on the developing roller 14.

The developer carried on the developing roller 14 is supplied to the electrostatic latent image (latent image) formed on the photosensitive drum 9 from the developing roller 14. Thus, the electrostatic latent image is developed by the developing roller 14, and images (toner images or developer images) are formed by toner on the surface of the photosensitive drum 9. In other words, the photosensitive drum 9 is an image carrying member which carries the image. Thereafter, a sheet is conveyed between the photosensitive drum 9 and the transfer roller 10 to transfer the developer image on the photosensitive drum 9 to the sheet.

Figure 2B:
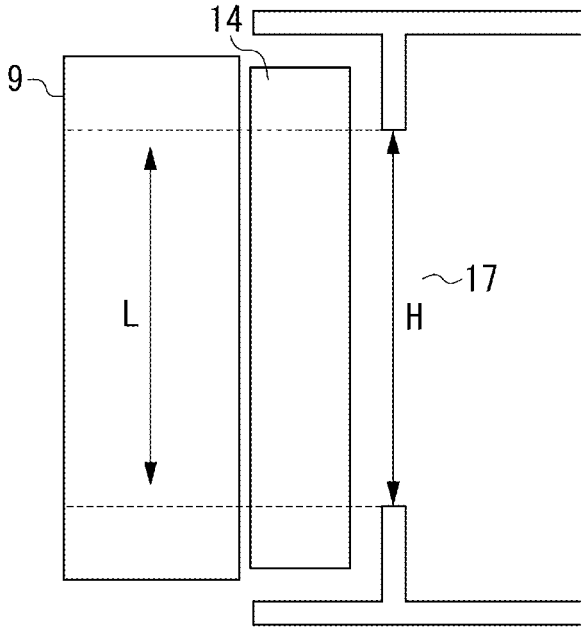

FIG. 2B is a cross section along a line A-A in FIG. 2A. As illustrated in FIG. 2B, an inside of the developer opening portion 17 provided in the developer storage unit 16 is referred to as a developer supply area H. The developer supply area H is an area where the toner can be supplied to the developing roller 14 from the developer storage unit 16. The developing roller 14 carries the toner inside the developer supply area H. An area where the latent image is formed on the photosensitive drum 9 is referred to as an image forming region L. In other words, the image forming region L is a maximum region where the exposure device 4 (refer to FIG. 1) can irradiate the photosensitive drum 9 with laser beams.

The image forming region L is equal to or smaller than the developer supply area H in width. The toner is moved to the latent image formed in the image forming region L of the photosensitive drum 9 from the developer supply area H of the developing roller 14 to develop the latent image, thereby forming a toner image. In other words, the image forming region L is a region where an image (a toner image) can be formed on the photosensitive drum 9.

Figure 3A:
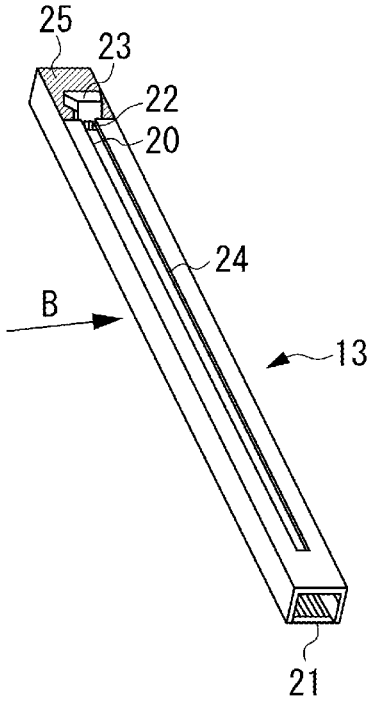
FIGS. 3A and 3B illustrate a charging device.
Figure 3B:
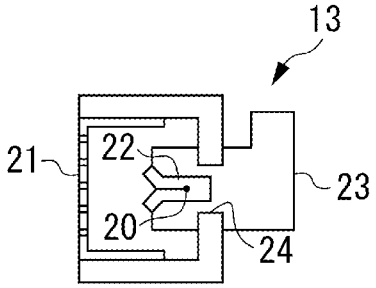

The charging device 13 is described below with reference to FIGS. 3A and 3B. FIG. 3A is a perspective view of the charging device 13. If a long side of the charging device 13 is referred to as a longitudinal direction, and a direction orthogonal to the longitudinal direction is referred to as a short direction, FIG. 3B is a cross section in the short direction. The longitudinal direction of the charging device 13 is the same as that of the photosensitive drum 9. That is, the longitudinal direction of the charging device 13 is a direction in which a rotating shaft (a rotation center) of the photosensitive drum 9 extends (an axial direction). Hereinafter, unless otherwise specified, a longitudinal direction is referred to as the longitudinal direction of the charging device 13 (i.e., the longitudinal direction of the photosensitive drum 9).

As illustrated in FIG. 3A, the charging device 13 includes a charging wire 20, a grid electrode 21, a cleaning member 22, a holding member 23, a guide 24, and a standby area 25.

The charging wire 20 is formed of a thin wire of tungsten or stainless steel, and is a metallic wire stretched in the longitudinal direction. As illustrated in FIG. 3B, the cleaning member 22 is formed of a rectangular parallelepiped sponge and arranged to cover a periphery of the charging wire 20. The holding member 23 for holding the cleaning member 22 fixes the cleaning member 22 with a two-sided adhesive tape or adhesive, and is longitudinally movably configured. Thereby, the holding member 23 moves in the longitudinal direction to move also the cleaning member 22 in the longitudinal direction, which cleans dirt (e.g., toner stuck thereto) on the surface of the charging wire 20.

When the charging wire 20 becomes dirty, the user detaches the process cartridge 5 from the apparatus main-body 2, and moves the holding member 23 in the longitudinal direction to allow the cleaning member 22 to wipe away the dirt on the charging wire 20. In other words, the holding member 23 is a force receiving unit for receiving force, from the outside, for moving the cleaning member 22. The cleaning member 22 moves together with the holding member 23 in the longitudinal direction.

As illustrated in FIG. 3A, the guide 24 is provided with the standby area 25 for the cleaning member 22 and the holding member 23 at the end thereof and outside the image forming region L. In other words, the process cartridge 5 is provided with a space (the standby area 25) for making the cleaning member 22 and the holding member 23 on standby at the end thereof in the longitudinal direction.

In the charging device 13 thus configured, a high voltage power supply (not illustrated) applies voltage between the charging wire 20 and the grid electrode 21 to generate corona discharge between the charging wire 20 and the grid electrode 21. Air around the charging wire 20 is ionized to generate ions. The ions serve to charge the periphery of the photosensitive drum 9.

Figure 4A:
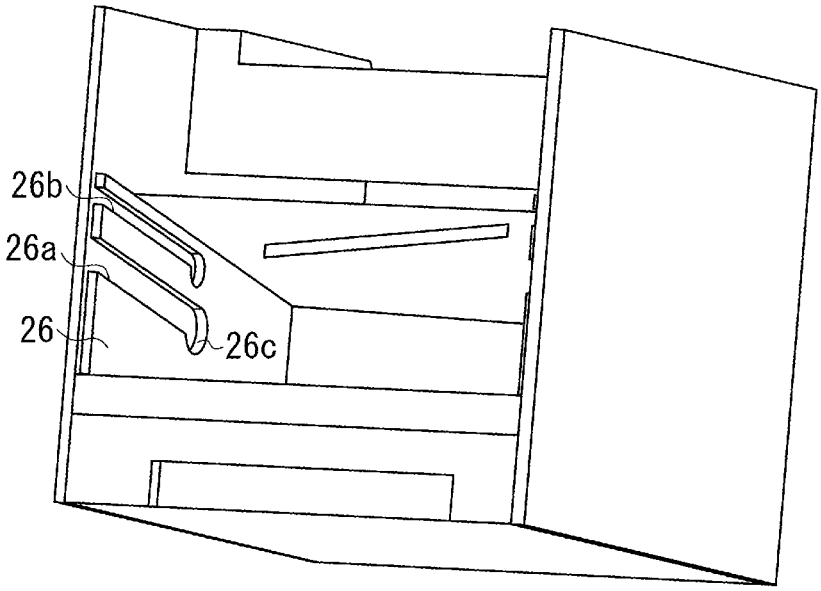
FIGS. 4A and 4B illustrate a configuration as to how a process cartridge is attached to and detached from an apparatus main-body.
Figure 4B:
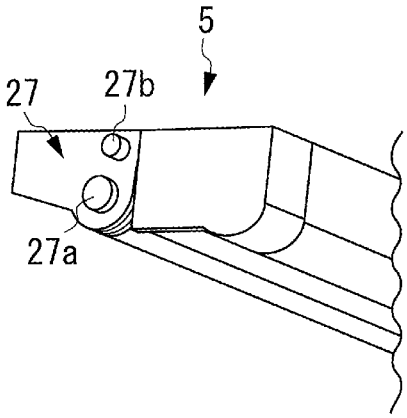

FIGS. 4A and 4B illustrate how the process cartridge 5 is attached to and detached from the apparatus main-body 2. Only the left side is illustrated because the left side is identical with the right side in configuration.

FIG. 4A is a perspective view of the apparatus main-body 2. As illustrated in FIG. 4A, an insertion guide 26 is provided on a side surface of the apparatus main-body 2. The insertion guide 26 is provided with first and second insertion guide faces 26*a* and 26*b* and a cylindrical face 26*c*. FIG. 4B is a perspective view of the process cartridge 5. As illustrated in FIG. 4B, the process cartridge 5 is provided with a first guided portion 27*a* contacting the first insertion guide face 26*a* and a second guided portion 27*b* contacting the second insertion guide face 26*b* as a guided portion 27.

The process cartridge 5 is inserted into the thus configured apparatus main-body 2 along the first and second insertion guide faces 26*a* and 26*b*, and the first guided portion 27*a* is fitted into the cylindrical face 26*c* to complete attachment.

FIGS. 5A, 5B, 5C and 5D illustrate how the holding member 23 according to the present invention moves. In the following description, the terms "right" and "left" refer to "right" and "left" as viewed from the front side of the apparatus main-body 2 as is the case with the above description.

Figure 5A:
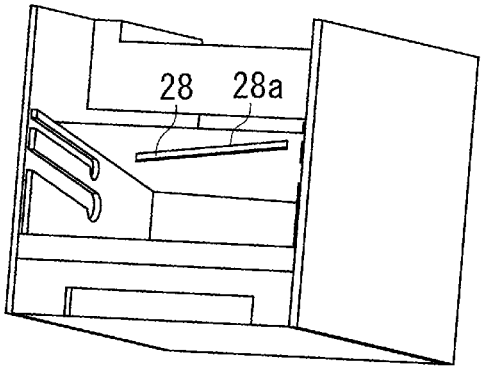
FIGS. 5A, 5B, 5C, and 5D illustrate a movement of a cleaning member and a holding member at the time of inserting the process cartridge to the apparatus main-body.

FIG. 5A is a perspective view of the apparatus main-body 2. As illustrated in FIG. 5A, the apparatus main-body 2 is provided with a contact member 28 in a position which is adjacent to the holding member 23 on an upper surface of the process cartridge 5 when the process cartridge 5 is inserted. The contact member 28 is provided with a slope 28*a* which slopes downstream from the right to the left in the longitudinal direction in the direction in which the process cartridge 5 is inserted.

In other words, the slope 28*a* is a slope portion which slopes in the attachment direction in which the process cartridge 5 is attached to the apparatus main-body 2. Both the right and the left of the slope 28*a* extend beyond the image forming region L. The holding member 23 of the process cartridge 5 is provided with a contact surface 23*a* which contacts the slope 28*a*.

Figure 5B:
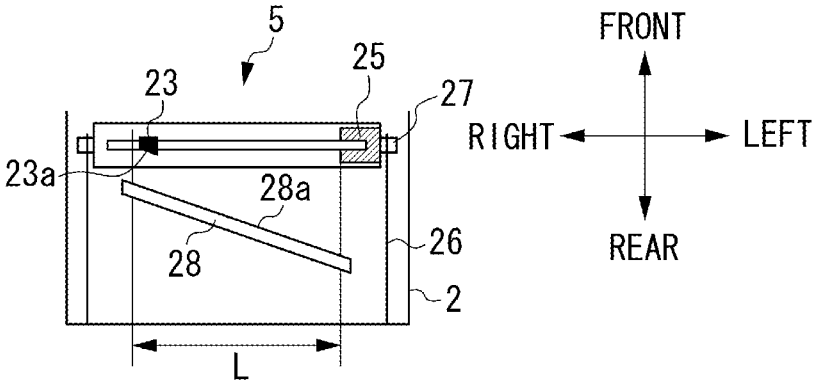
Figure 5C:
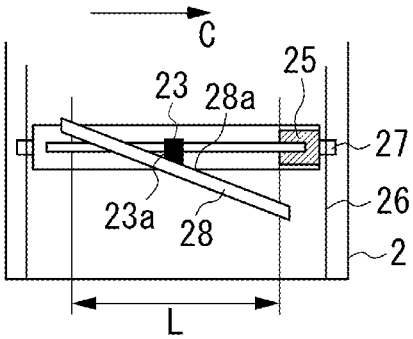

If the process cartridge 5 whose holding member 23 is kept remained in the image forming region L is inserted (attached) to the thus configured apparatus main-body 2, as illustrated in FIG. 5B, the guided portion 27 of the process cartridge 5 is engaged with the insertion guide 26. As illustrated in FIG. 5C, the process cartridge 5 is further inserted along the insertion guide 26 in an insertion direction to cause the slope 28*a* to contact the contact surface 23*a*, moving the cleaning member 22 in a moving direction C along the guide 24 of the charging device 13. Force is applied to the contact surface 23*a* of the holding member 23 to cause the slope 28*a* to move the cleaning member 22 to the outside in the longitudinal direction.

Figure 5D:
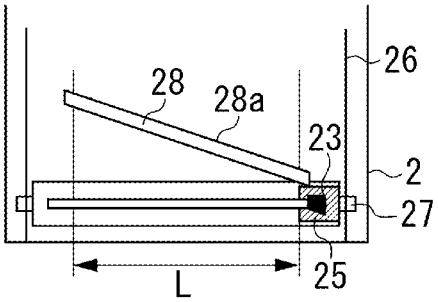

As illustrated in FIG. 5D, when insertion is completed, the holding member 23 and the cleaning member 22 are moved to the standby area 25 outside the image forming region L. For this reason, the charging wire 20 in the image forming region L is not covered with the cleaning member 22 to prevent an image defective from occurring due to a charge defective.

The configuration of the foregoing present exemplary embodiment is summarized below. The image forming apparatus according to the present exemplary embodiment includes the process cartridge 5 that is attachable to and detachable from the apparatus. The process cartridge 5 includes the photosensitive drum (the image carrying member) 9 for carrying an image (a toner image) and the charging device (the charging member) 13 for charging the photosensitive drum 9. The process cartridge 5 further includes the cleaning member 22 which contacts the charging wire 20 configuring the charging device 13 to clean the charging wire 20 and the holding member (the force receiving unit) 23 for receiving force for moving the cleaning member 22.

The apparatus main-body 2 includes the slope (the slope portion) 28*a* which slopes in the attachment direction where the process cartridge 5 is attached to the apparatus main-body 2. The process cartridge 5 is attached to the apparatus main-body 2 with the holding member 23 arranged in the image forming region L to contact the holding member 23 with the slope 28*a* in the process of attachment. According to a movement of the process cartridge 5, the holding member 23 moves to the outside in the longitudinal direction of the photosensitive drum 9. Furthermore, according to such movement of the holding member 23, the cleaning member 22 also moves to the outside in the longitudinal direction to retract into a region (a retract region 25) outside the image forming region L.

In other words, force is applied to the holding member 23 provided on the cleaning member 22 to cause the slope 28*a* to move the cleaning member 22 to the outside in the longitudinal direction.

Because the cleaning member 22 lies in the outside the image forming region L in a case where the process cartridge 5 is attached to the apparatus main-body 2, the cleaning member 22 never prevents the charging device 13 (the charging wire 20) from charging at the time of forming images. The charging device 13 is inhibited from causing a charge defective to inhibit also an image defective from being caused on an image formed by the image forming apparatus. The user has only to attach the process cartridge 5 thereto to move the cleaning member 22 to the outside of the image forming region L. This can reduce a burden to the user.

Figure 6A:
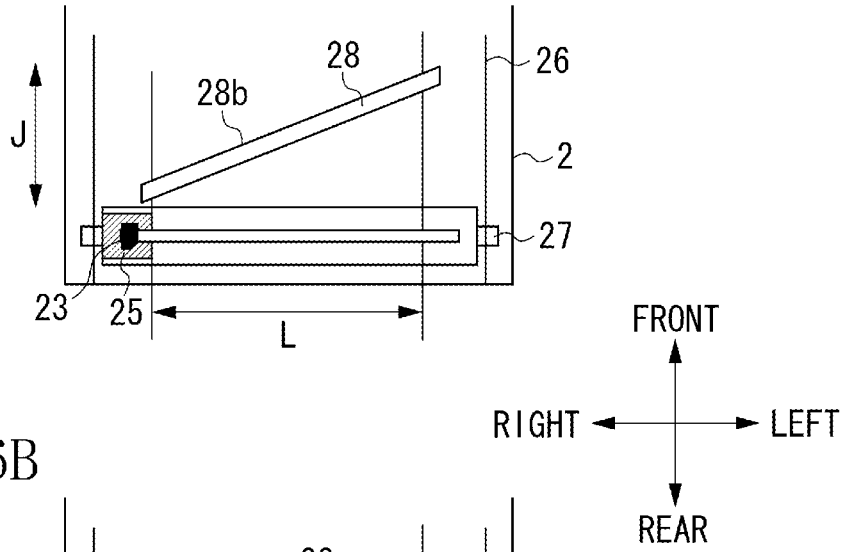
FIGS. 6A, 6B, and 6C illustrate modification examples of a contact member.
Figure 6B:
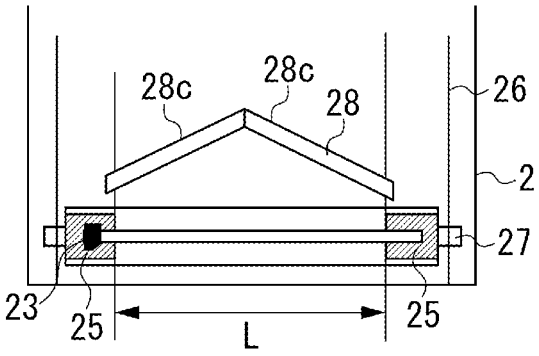
Figure 6C:
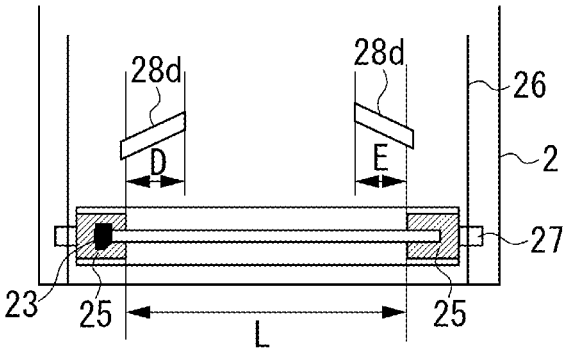

Modification examples of the contact member 28 are described below with reference to FIGS. 6A, 6B, and 6C. FIGS. 6A, 6B, and 6C illustrate the modification examples of the contact member 28. In the present exemplary embodiment, the standby area 25 is provided on the left to cause the slope 28*a* to move the holding member 23 to the left side. However, as illustrated in FIG. 6A, the standby area 25 is provided on the right and the contact member 28 may be provided with a slope 28*b* which slopes downstream from the left to the right in the longitudinal direction in the direction in which the process cartridge 5 is inserted.

As illustrated in FIG. 6B, the contact member 28 may be configured with two slopes (the slope portions) 28*c* which slope downstream from the inside of the image forming region L to the outside thereof in the insertion direction. The two slopes 28*c* incline in a direction different from each other and are coupled. The standby areas 25 where the holding member 23 and the cleaning member 22 are on standby are located in a position outside the image forming region L in the longitudinal direction and provided on both sides of the image forming region L.

The two slopes 28*c* move the holding member 23 (the cleaning member 22) in the opposite directions (different directions) when contacting the holding member 23. One of the two slopes 28*c* provided on the left side moves the holding member 23 (the cleaning member 22) to the left side. The other of the two slopes 28*c* provided on the right side moves the holding member 23 (the cleaning member 22) to the right side.

In the aforementioned exemplary embodiment and modification examples, the contact member 28 (the slopes 28*a*, 28*b*, and 28*c*) is provided all over the image forming region in the longitudinal direction. However, as illustrated in FIG. 6C, the contact member 28 may be provided only on a part of the longitudinal direction. In FIG. 6C, the contact member 28 is formed only by two slopes (the slope portions) 28*d* provided on both sides of the image forming region L. The two slopes 28*d* incline in a direction different from each other and are separate from each other (not coupled).

In the present modification example, the contact members 28 are provided only on both sides in the longitudinal direction, but not at the center in the longitudinal direction. FIG. 6C illustrates a modification example on the presumption that a user has left the holding member 23 in regions (regions D and E in the figure) in the neighborhood of inside ends of the image forming region L without completely returning the holding member 23 to the outside of the image forming region L.

The present modification example is also configured such that the user inserts the process cartridge 5 into the apparatus main-body 2 to cause the slopes 28*d* to move the holding member 23 and the cleaning member 22 to the outside of the image forming region L. In this case, the standby areas 25 of the holding member 23 and the cleaning member 22 are provided on both sides outside the image forming region L in the longitudinal direction as in the case of FIG. 6B.

Also in the configuration of the above modification examples, the holding member 23 and the cleaning member 22, which lie in the image forming region L, can be moved to the standby area 25 outside the image forming region L while the process cartridge 5 is being inserted into the apparatus main-body 2. In other words, the holding member 23 and the cleaning member 22 can be moved to the outside of the image forming region L by the slopes 28*b*, 28*c*, and 28*d* of the contact member 28. This allows preventing the occurrence of an image defective due to a charge defective. The effects of the configuration described in FIGS. 6A, 6B, and 6C are described below.

The moving amount of the cleaning member 22 is smaller in FIG. 6B than in FIG. 6A. In other words, in the configuration of FIG. 6A, the maximum moving amount of the cleaning member 22 is substantially equal to the length of the image forming region L. On the other hand, in the configuration of FIG. 6B, the maximum moving amount of the cleaning member 22 is about half of the image forming region L. A burden put on the user when the cleaning member 22 is moved can be reduced. A space required for the apparatus main-body 2 to arrange the slopes 28*c* does not have to be large. This allows the image forming apparatus 1 to be downsized.

In the configuration of FIG. 6A (or FIG. 5B), the slope 28*b* is longer, so that a comparatively larger space J needs to be secured in the apparatus main-body 2. However, a single slope 28*b* has only to be provided, so that the holding member 23 never be caught by the slope 28*b*.

That is, in the configuration of FIG. 6B, two slopes 28*c* are provided. If the holding member 23 (the cleaning member 22) is arranged in the vicinity of a boundary portion of the two slopes (at the center portion of the image forming region L), the holding member 23 contacts the boundary of the two slopes, which may move the cleaning member 22 neither to the right nor to the left. For this reason, in the configuration of FIG. 6B, the holding member 23 may need to be rounded off in shape or decreased in size not to be caught by the two slopes 28*c* therebetween.

In the configuration of FIG. 6A, on the other hand, the holding member 23 has no risk of being caught by the slope 28*b*, so that the respective shapes and dimensions of the holding member 23 and the slope 28*b* can be freely determined.

In the configuration of FIG. 6C, a space required for arranging the slopes 28*d* is further decreased in comparison with that of FIG. 6B to allow the image forming apparatus 1 to be further downsized. On the other hand, when the process cartridge 5 is attached therein with the cleaning member 22 lying at the center portion of the image forming region L, the holding member 23 does not contact the slopes 28*d* not to allow the cleaning member 22 to be moved to the standby area 25.

However, the possibility that the cleaning member 22 is left at the center portion of the image forming region L is comparatively small. In most cases, it seems that the cleaning member 22 is left in the image forming region L when the user cannot move it sufficiently to the outside of the region in the longitudinal direction. That is, in that case, the cleaning member 22 is positioned at the end portions of the image forming region L, so that the slopes 28*d* are merely arranged only on both sides of the image forming region L to allow the cleaning member 22 to be moved to the standby area 25 in most cases.

Figure 7A:
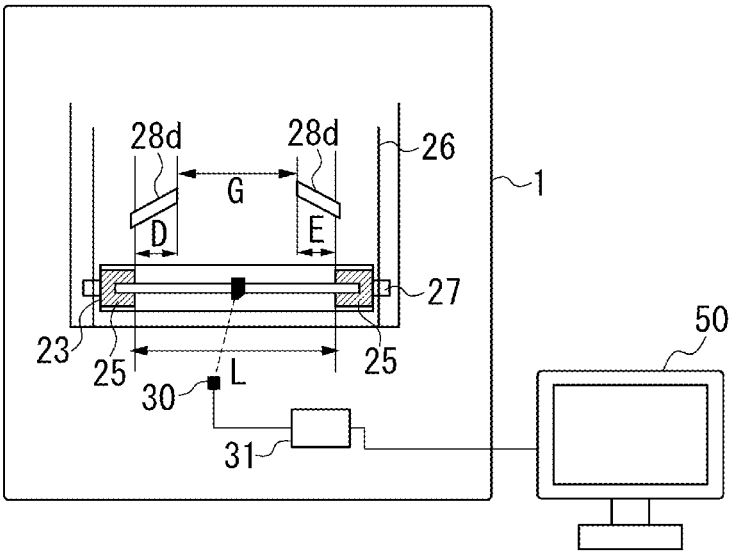
FIGS. 7A and 7B illustrate modification examples of the contact member.

In FIG. 7A illustrated as an example developed from the configuration of FIG. 6C, a sensor 30 for detecting whether the cleaning member 22 lies inside the image forming region L can be provided in the apparatus main-body 2. In a case where the sensor 30 detects that the process cartridge 5 is attached to the apparatus main-body 2 with the cleaning member 22 arranged at a region G where the slopes 28*d* are not arranged (the center portion of the image forming region L), the user has only to be notified that an image cannot be formed. In other words, it is recommendable that a control unit (a central processing unit (CPU)) 31 provided in the image forming apparatus 1 (the apparatus main-body 2) determines that an image is not formed in a case where the cleaning member 22 lies in the image forming region L.

It is also recommendable that the control unit 31 causes a display provided on the image forming apparatus 1 or a monitor of a computer 50 connected with the image forming apparatus 1 to display that an image cannot be formed or the cleaning member 22 needs to be moved to the standby area 25.

Alternatively, in a case where the cleaning member 22 is arranged at the region G where the slopes 28*d* are not arranged (the center portion of the image forming region L), the holding member 23 may be caused to collide with the apparatus main-body 2 to prevent the process cartridge 5 from being attached to the apparatus main-body 2.

Figure 7B:
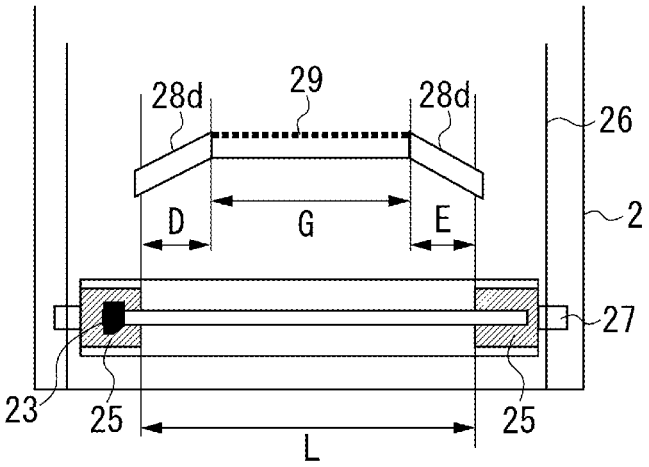

FIG. 7B, as an example developed from the configuration of FIG. 6C, illustrates an attachment inhibition unit 29 capable of touching the holding member 23 provided between the two slopes 28*d*. More specifically, the process cartridge 5 is attached to the apparatus main-body 2 with the cleaning member 22 arranged at the center portion of the image forming region L to cause the attachment inhibition unit 29 to contact the holding member 23, preventing the process cartridge 5 from being moved (attached).

The attachment inhibition unit 29 is provided to contact the holding member 23, however, the attachment inhibition unit 29 is configured to collide with the cleaning member 22, which prevents the process cartridge 5 from being moved (attached).

As described above, the configuration of the slope can be selected as required, as illustrated in FIGS. 6A, 6B, and 6C, according to the size required of the apparatus main-body 2 and the shape required of the holding member 23 (the shape and size of the holding member 23 are made user friendly, for example).

The present exemplary embodiment has described above the configuration in which the cleaning member 22 and the holding member 23 are separate members, and the cleaning member 22 is fixed to the holding member 23. However, from the viewpoint of cost reduction, even if the cleaning member 22 is integrated with the holding member (the force receiving unit) 23, an equivalent effect can be achieved. In other words, a portion of the cleaning member 22 may be the force receiving unit for contacting the contact member 28.

The cleaning member 22 is a member for cleaning the charging wire 20 of the charging member. However, the cleaning member 22 may be a member for cleaning the grid electrode 21.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-012729 filed Jan. 27, 2014, which is hereby incorporated by reference herein in its entirety.

What is claimed is:

1. An image forming apparatus configured to form an image on a recording medium, in which an apparatus main-body to and from which a process cartridge can be attached and detached is provided, wherein the process cartridge includes:

an image carrying member configured to carry an image;

a charging member configured to charge the image carrying member;

a cleaning member configured to clean the charging member by contacting the charging member; and a force receiving unit configured to receive a force for moving the cleaning member in a longitudinal direction of the image carrying member, wherein the apparatus main-body includes a slope portion which slopes in a direction in which the process cartridge is attached and which contacts the force receiving unit to apply the force in a process where the process cartridge is attached to the apparatus main-body, and, in a case where a region where an image can be formed on the image carrying member is taken as an image forming region, the slope portion applies the force to the force receiving unit to move the cleaning member from an inside to an outside of the image forming region, and wherein the apparatus main-body includes two slope portions, functioning as the slope portion, which slope in a direction different from each other, and the two slope portions move the cleaning member in opposite directions in the longitudinal direction respectively when contacting the force receiving unit.

2. The image forming apparatus according to claim 1, wherein the slope portion is provided throughout the image forming region.

3. The image forming apparatus according to claim 1, wherein the two slope portions are arranged apart from each other on both sides in the longitudinal direction.

4. The image forming apparatus according to claim 3, wherein the image forming apparatus does not form an image in a case where the process cartridge is attached to the apparatus main-body with the cleaning member arranged between the two slope portions.

5. The image forming apparatus according to claim 3, wherein the apparatus main-body includes an attachment inhibition unit which is arranged between the two slope portions and contacts the force receiving unit or the cleaning member to inhibit the process cartridge from being attached to the apparatus main-body.

6. The image forming apparatus according to claim 1, wherein the charging member includes a wire stretched in the longitudinal direction, and the cleaning member contacts the wire to clean the wire.

7. The image forming apparatus according to claim 6, wherein the charging member further includes an electrode which discharges between the electrode and the wire to charge the image carrying member.

8. The image forming apparatus according to claim 1, wherein the force receiving unit is a holding member holding the cleaning member.

9. The image forming apparatus according to claim 1, wherein the force receiving unit is a part of the cleaning member.

10. The image forming apparatus according to claim 1, comprising the process cartridge.

11. A process cartridge configured to be attachable to and detachable from an apparatus main-body of an image forming apparatus, the process cartridge comprising:

an image carrying member configured to carry an image;

a charging member configured to charge the image carrying member;

a cleaning member configured to clean the charging member by contacting the charging member; and a force receiving unit configured to receive a force for moving the cleaning member in a longitudinal direction of the image carrying member, wherein the apparatus main-body includes a slope portion which slopes in a direction in which the process cartridge is attached, and the force receiving unit contacts the slope portion to receive the force in a process where the process cartridge is attached and receives, in a case where a region where an image can be formed on the image carrying member is taken as an image forming region, the force from the slope portion to move the cleaning member from an inside to an outside of the image forming region, and wherein the apparatus main-body includes two slope portions functioning as the slope portion which slope in a direction different from each other, and, when the force receiving unit contacts one of the two slope portions, the force receiving unit moves the cleaning member in a direction opposite to a direction in which the force receiving unit moves the cleaning member when the force receiving unit contacts the other of the two slope portions.

12. The process cartridge according to claim 11, wherein the charging member includes a wire stretched in the longitudinal direction of the image carrying member, and the cleaning member contacts the wire to clean the wire.

13. The process cartridge according to claim 12, wherein the charging member further includes an electrode which discharges between the electrode and the wire to charge the image carrying member.

14. The process cartridge according to claim 11, wherein the force receiving unit is a holding member holding the cleaning member.

15. The process cartridge according to claim 11, wherein the force receiving unit is a part of the cleaning member.

* * * * *